US008485260B2

(12) United States Patent
Donohue et al.

(10) Patent No.: US 8,485,260 B2
(45) **Date of Patent: *Jul. 16, 2013**

(54) MODULAR BACKUP FLUID SUPPLY SYSTEM

(75) Inventors: Steve Donohue, Sugar Land, TX (US); Angela Donohue, legal representative, Sugar Land, TX (US); Steve O'Leary, Houston, TX (US); Tom Thrash, Houston, TX (US)

(73) Assignee: Transocean Offshore Deepwater Drilling, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/435,608

(22) Filed: Mar. 30, 2012

(65) Prior Publication Data

US 2012/0186820 A1 Jul. 26, 2012

Related U.S. Application Data

(60) Continuation of application No. 12/814,212, filed on Jun. 11, 2010, now Pat. No. 8,186,441, which is a division of application No. 11/461,913, filed on Aug. 2, 2006, now Pat. No. 7,757,772.

(60) Provisional application No. 60/705,538, filed on Aug. 2, 2005.

(51) Int. Cl.
*E21B 33/06* (2006.01)

(52) U.S. Cl.
USPC ..... 166/344; 166/341; 166/351; 166/368; 137/884

(58) Field of Classification Search
USPC ..... 166/341, 338, 339, 344, 347, 351, 166/368, 373, 381, 386; 405/191; 137/884; 251/1.1
See application file for complete search history.

(56) References Cited

U.S. PATENT DOCUMENTS

| | | | | | |
|---|---|---|---|---|---|
| 3,921,500 | A | * | 11/1975 | Silcox | 91/4 R |
| 4,174,000 | A | * | 11/1979 | Milberger | 166/363 |
| 4,257,311 | A | * | 3/1981 | Barnsley et al. | 91/363 A |
| 4,401,164 | A | | 8/1983 | Baugh | |
| 4,880,025 | A | * | 11/1989 | McMahan et al. | 137/1 |
| 4,930,401 | A | * | 6/1990 | Cameron et al. | 91/32 |

(Continued)

FOREIGN PATENT DOCUMENTS

GB 2264737 9/1993

OTHER PUBLICATIONS

Mason et at., "Surface BOP: Testing and Completing Deepwater Wells Drilled With a Surface BOP Rig"; SPE Drilling & Completion; Mar. 2005; 54-61.

*Primary Examiner* — Matthew Buck
(74) *Attorney, Agent, or Firm* — Fulbright & Jaworski LLP

(57) ABSTRACT

A system and method to allow backup or alternate fluid flow routes around malfunctioning components using removable, modular component sets. In one exemplary embodiment, an ROV establishes a backup hydraulic flow to a BOP function by attaching one end of a hose to a modular valve block and the other end to an intervention shuttle valve, thus circumventing and isolating malfunctioning components. A compound intervention shuttle valve is provided that comprises first and second primary inlets, first and second secondary inlets, and an outlet. A modular valve block is provided that comprises a directional control valve, a pilot valve, a manifold pressure regulator, a pilot pressure regulator, stab type hydraulic connections and an electrical wet-make connection.

20 Claims, 10 Drawing Sheets

U.S. PATENT DOCUMENTS

| | | | | | |
|---|---|---|---|---|---|
| 5,032,704 | A | * | 7/1991 | Neff et al. | 219/89 |
| 5,070,904 | A | * | 12/1991 | McMahon et al. | 137/560 |
| 5,238,371 | A | * | 8/1993 | Benckert | 417/345 |
| 5,261,232 | A | * | 11/1993 | Maffini et al. | 60/429 |
| 5,295,547 | A | * | 3/1994 | Coelho et al. | 166/368 |
| 5,456,313 | A | * | 10/1995 | Hopper et al. | 166/97.1 |
| 5,676,209 | A | * | 10/1997 | Reynolds | 166/345 |
| 6,032,742 | A | * | 3/2000 | Tomlin et al. | 166/345 |
| 6,047,781 | A | | 4/2000 | Scott et al. | |
| 6,068,427 | A | * | 5/2000 | Østergaard | 405/191 |
| 6,161,586 | A | | 12/2000 | Hirata et al. | |
| 6,161,618 | A | | 12/2000 | Parks et al. | |
| 6,234,717 | B1 | | 5/2001 | Corbetta | |
| 6,257,268 | B1 | * | 7/2001 | Hope et al. | 137/112 |
| 6,422,315 | B1 | * | 7/2002 | Dean | 166/339 |
| 6,474,416 | B2 | | 11/2002 | Beall et al. | |
| 6,484,806 | B2 | * | 11/2002 | Childers et al. | 166/351 |
| 6,622,799 | B2 | * | 9/2003 | Dean | 166/381 |
| 6,640,901 | B1 | * | 11/2003 | Appleford et al. | 166/357 |
| 6,644,410 | B1 | * | 11/2003 | Lindsey-Curran et al. | 166/360 |
| 6,873,063 | B1 | * | 3/2005 | Appleford et al. | 307/149 |
| 7,216,714 | B2 | * | 5/2007 | Reynolds | 166/338 |
| 7,216,715 | B2 | * | 5/2007 | Reynolds | 166/339 |
| 7,222,674 | B2 | * | 5/2007 | Reynolds | 166/341 |
| 7,347,270 | B2 | * | 3/2008 | McMillan et al. | 166/332.8 |
| 7,389,814 | B2 | * | 6/2008 | Irwin, Jr. | 166/53 |
| 7,757,772 | B2 | * | 7/2010 | Donohue et al. | 166/344 |
| 8,186,441 | B2 | * | 5/2012 | Donohue et al. | 166/344 |
| 2003/0042025 | A1 | | 3/2003 | Fenton et al. | |
| 2004/0216884 | A1 | * | 11/2004 | Bodine et al. | 166/335 |
| 2005/0039923 | A1 | * | 2/2005 | Howe et al. | 166/368 |
| 2009/0194290 | A1 | * | 8/2009 | Parks et al. | 166/339 |

* cited by examiner

MODULAR BACKUP FLUID SUPPLY SYSTEM

CROSS-REFERENCE TO RELATED APPLICATIONS

This application is a continuation of Ser. No. 12/814,212 filed Jun. 11, 2010 which is a divisional of U.S. Pat. No. 7,757,772 issued Jul. 20, 2012 claiming priority to provisional Application No. 60/705,538.

TECHNICAL FIELD

The invention relates generally to a fluid supply system and apparatus and, more particularly, to a modular backup hydraulic fluid supply system and apparatus.

BACKGROUND OF THE INVENTION

Subsea drilling operations may experience a blow out, which is an uncontrolled flow of formation fluids into the drilling well. Blow outs are dangerous and costly. Blow outs can cause loss of life, pollution, damage to drilling equipment, and loss of well production. To prevent blowouts, blowout prevention (BOP) equipment is required. BOP equipment typically includes a series of functions capable of safely isolating and controlling the formation pressures and fluids at the drilling site. BOP functions include opening and closing hydraulically operated pipe rams, annular seals, shear rams designed to cut the pipe, a series of remote operated valves to allow controlled flow of drilling fluids, and well re-entry equipment. In addition, process and condition monitoring devices complete the BOP system. The drilling industry refers to the BOP system in total as the BOP Stack.

The well and BOP connect to the surface drilling vessel through a marine riser pipe, which carries formation fluids (e.g., oil, etc.) to the surface and circulates drilling fluids. The marine riser pipe connects to the BOP through the Lower Marine Riser Package ("LMRP"), which contains a device to connect to the BOP, an annular seal for well control, and flow control devices to supply hydraulic fluids for the operation of the BOP. The LMRP and the BOP are commonly referred to collectively as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes hydraulic control systems for controlling the various BOP functions, each of which has various flow control components upstream of it. An operator on the surface vessel typically operates the flow control components and the BOP functions via an electronic multiplex control system.

Certain drilling or environmental situations require an operator to disconnect the LMRP from the BOP and retrieve the riser and LMRP to the surface vessel. The BOP functions must contain the well when a LMRP is disconnected so that formation fluids do not escape into the environment. To increase the likelihood that a well will be contained in an upset or disconnect condition, companies typically include redundant systems designed to prevent loss of control if one control component fails. Usually, companies provide redundancy by installing two separate independent central control units to double all critical control units. The industry refers to the two central control units as a blue pod and a yellow pod. Only one pod is used at a time, with the other providing backup.

While the industry designed early versions of the pods to be retrievable in the event of component failure, later versions have increased in size and cannot be efficiently retrieved. Further, while prior art systems have dual redundancy, this redundancy is often only safety redundancy but not operational redundancy, meaning that a single component failure will require stopping drilling operations, making the well safe, and replacing the failed component. Stopping drilling to replace components often represents a major out of service period and significant revenue loss for drilling contractors and operators.

The industry needs a simple and cost effective method to provide added redundancy and prevent unplanned stack retrievals. The industry needs an easily retrievable system that allows continued safe operation during component down time and integrates easily and quickly into existing well control systems. The industry needs a simpler, economic, and effective method of controlling subsea well control equipment.

BRIEF SUMMARY OF THE INVENTION

In some embodiments, the present invention provides an improved method and apparatus to provide redundancy to fluid flow components via alternative flow routes. In some embodiments, the present invention allows for safe and efficient bypass of faulty components while allowing continued flow to functions or destinations. The present invention can be integrated into various existing flow systems or placed on entirely new flow systems to provide a layer of efficient redundancy. In other embodiments, the present invention relates to a stand alone control system for subsea blow out prevention (BOP) control functions. The present invention is particularly useful for hydraulically operated control systems and functions in water depths of 10,000 feet or more.

In some embodiments, a fluid supply apparatus comprises a primary fluid flow route that includes one or more primary flow control components, an intervention shuttle valve, and a destination and a secondary fluid flow route that bypasses the primary flow control components, and includes a modular removable block of one or more secondary flow control components, the intervention shuttle valve, a selectively removable hose that connects the modular removable block of secondary flow control components to the intervention shuttle valve, and the destination. A remotely operated vehicle (ROV) may deploy selectable hydraulic supply to a BOP function that has lost conventional control. In some embodiments, the intervention shuttle valve has an outlet that is hard piped to a BOP function and a secondary inlet that is hard piped from a receiver plate.

In some embodiments, the modular valve block is removable and includes a directional control valve. More directional control valves may be placed on modular valve block, with the number of directional control valves corresponding to the number of BOP functions that it may simultaneously serve. Modular valve block is generally retrievable by an ROV, thus making repair and exchange easy. Further, the modular nature of the valve block means that a replacement valve block may be stored and deployed when an existing valve block requires maintenance or service. Many other components may be placed on the modular valve block, including pilot valves, and pressure regulators accumulators. Pilot valves may be hydraulic pilots or solenoid operated.

In some embodiments, the modular valve block connects to the BOP stack via pressure balanced stab connections, and in embodiments requiring electrical connection, via electrical wet-make connection. In some embodiments, the modular valve block mounts onto a modular block receiver that is fixably attached to BOP stack. Preferably, the modular block receiver is universal so that many different modular valve blocks can connect to it. In some embodiments, either the modular valve block or the modular block receiver is connected to a temporary connector for receiving a hose to connect the modular valve block to an intervention shuttle valve.

In some embodiments, the intervention shuttle valve comprises a housing having a generally cylindrical cavity, a primary inlet entering the side of the housing, a secondary inlet entering an end of the housing, a spool-type shuttle having a detent means, and an outlet exiting a side of the housing. In some embodiments, the outlet is hard piped to a destination, and the primary inlet is hard piped a primary fluid source. During normal flow, the shuttle is in the normal flow position and fluid enters the primary inlet and flows around the shuttle stem and out of the outlet. The shuttle design seals fluid from traveling into other areas. When backup flow is introduced into secondary inlet, the fluid forces the shuttle to the actuated position, isolating the primary inlet and allowing flow only from the secondary inlet.

In some embodiments a compound intervention shuttle valve comprises two intervention shuttle valves whose outlets are attached to the inlets of a gate shuttle valve. Thus, the compound intervention shuttle valve comprises two primary inlets, two secondary inlets, and an outlet. The gate shuttle valve is similar to the intervention shuttle valve in that it has a shuttle that shifts to allow flow from one inlet and to isolate flow from the other inlet, but generally has a different shuttle design.

In some embodiments, a BOP hydraulic control system includes a blue central control pod, a yellow central control pod, and at least one modular valve block associated with each pod to provide universal backup for all control pod components. The modular valve blocks have an outlet that attaches to a hose via a temporary connection, and the other end of the hose attaches to any one of a number of intervention shuttle valves, each associated with a BOP function. Thus, each modular valve block provides redundancy for at least one BOP function.

In another embodiment, the invention comprises a stand alone subsea control system, modular in construction and providing retrievable, local, and independent control of a plurality of hydraulic components commonly employed on subsea BOP systems. Such a system eliminates the need for separate control pods. Other embodiments allow independent ROV intervention using an emergency hydraulic line routed from the surface to an ISV in the case of catastrophic system control failure of all BOP functions.

Independent and/or redundant control over BOP functions reduces downtime and increases safety. Furthermore, a control system having easily retrievable components allows fast and easy maintenance and replacement. The present invention, in some embodiments is compatible with a multitude of established systems and provides inexpensive redundancy for BOP system components. In another embodiment of the invention, control over the modular block valves is transparently integrated into an existing multiplex control system, allowing an operator to control the modular valve block using the existing control system.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

As used herein, the use of the word "a" or "an" when used in conjunction with the term "comprising" (or the synonymous "having") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

Figure 1:
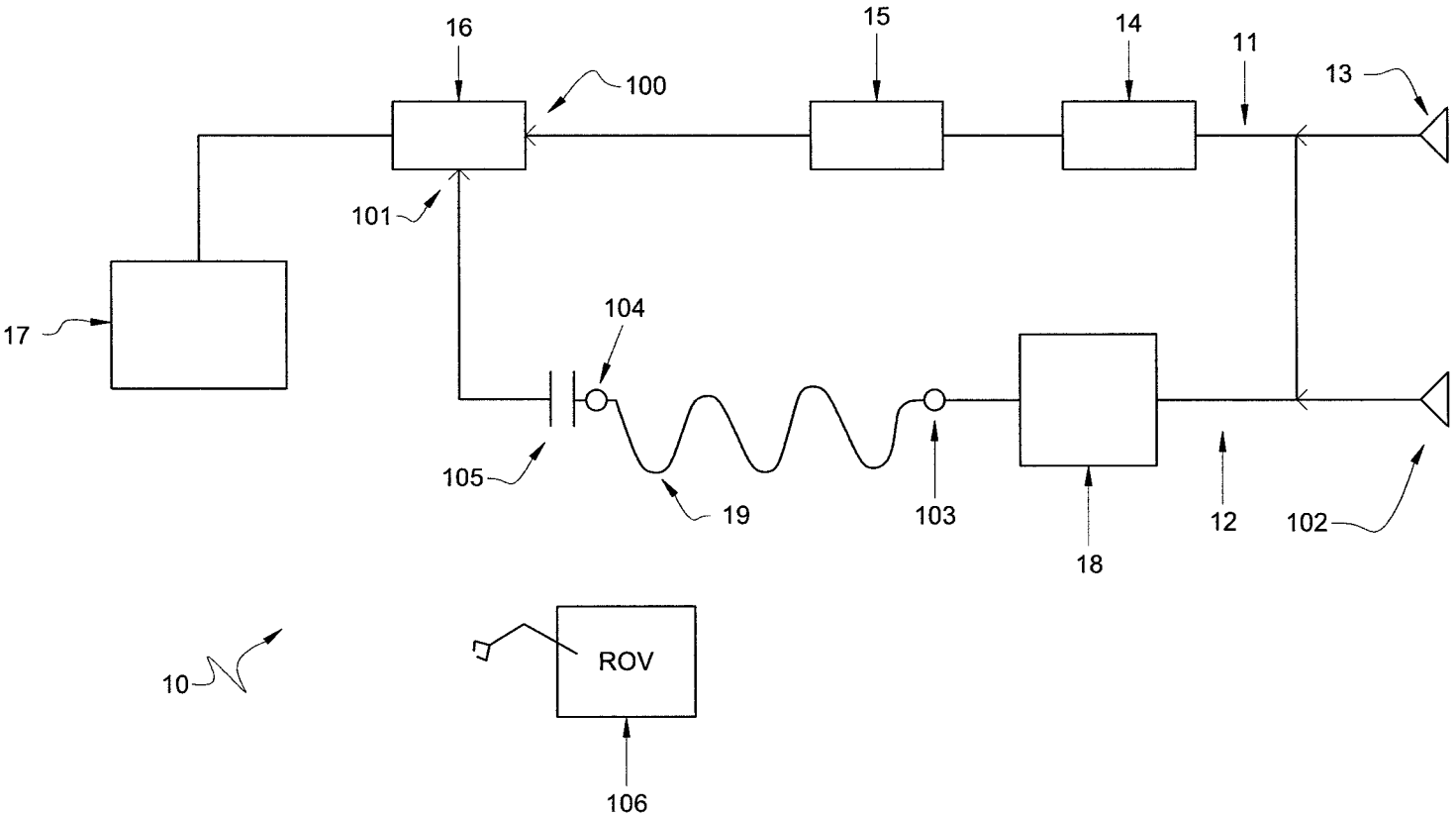
FIG. 1 is a schematic diagram of a subsea control module representing one embodiment of the present invention.

Referring to FIG. 1, one embodiment of the present invention comprises redundant fluid supply apparatus 10, comprising primary fluid flow route 11 and secondary fluid flow route 12. Primary fluid flow route 11 begins at fluid source 13 and continues through primary flow control components 14 and 15, through primary inlet 100 of intervention shuttle valve 16 and to destination 17. Secondary fluid flow route 12 begins at either fluid source 13 or alternate fluid source 102 and continues through modular valve block 18, through selectively removable hose 19, through secondary inlet 101 of intervention shuttle valve 16, and to destination 17.

Although FIG. 1 shows two primary flow components 14 and 15, there may be any number of components. Primary flow components 14 and 15 may comprise any component in a fluid flow system, such as, but not limited to, valves, pipes, hoses, seals, connections, and instrumentation. Modular valve block 18 may comprise any modular, removable flow control components, at least one of which should compensate for the bypassed fluid components 14 and 15. Although described in more detail below, intervention shuttle valve 16 accepts fluid through either primary inlet 100 secondary inlet 101. When flow is through secondary inlet 101, components upstream of primary inlet 100 are isolated and bypassed, but fluid continues to flow to destination 17 via secondary fluid flow route 12.

Hose 19 connects to modular valve block 18 via temporary connection 103 and to secondary inlet 101 of intervention shuttle valve 16 via temporary connection 104. In some embodiments, temporary connection 103 attaches directly to modular valve block 18, while in other embodiments piping and other equipment exists between them. Similarly, in some embodiments temporary connection 104 attaches directly to secondary inlet 101, while in other embodiments piping and other equipment exists between them.

Temporary connections 103 and 104 comprise commercially available stab connections, such as those having an external self-aligning hydraulic link that extends into a connection port and mates with its hydraulic circuit. Generally, a stab connection comprises a receiver or female portions and a stab or male portion, and either portion may be referred to generically as a stab connection. In one embodiment, secondary inlet 101 connects via piping to receiver plate 105 that houses temporary connection 104 and may house other temporary connections.

In some embodiments, fluid supply apparatus 10 comprises remote operated vehicle (ROV) 106 that deploys hose 19 and connects it to modular valve block 18 and secondary inlet 101 of intervention shuttle valve 16. ROV 106 may also disconnect hose 19 and connect and disconnect modular valve block 18. ROV 106 may be operated from the surface by a human operator, or it may be preprogrammed to perform specific connections or disconnections based on input from a multiplex control system.

Figure 2:
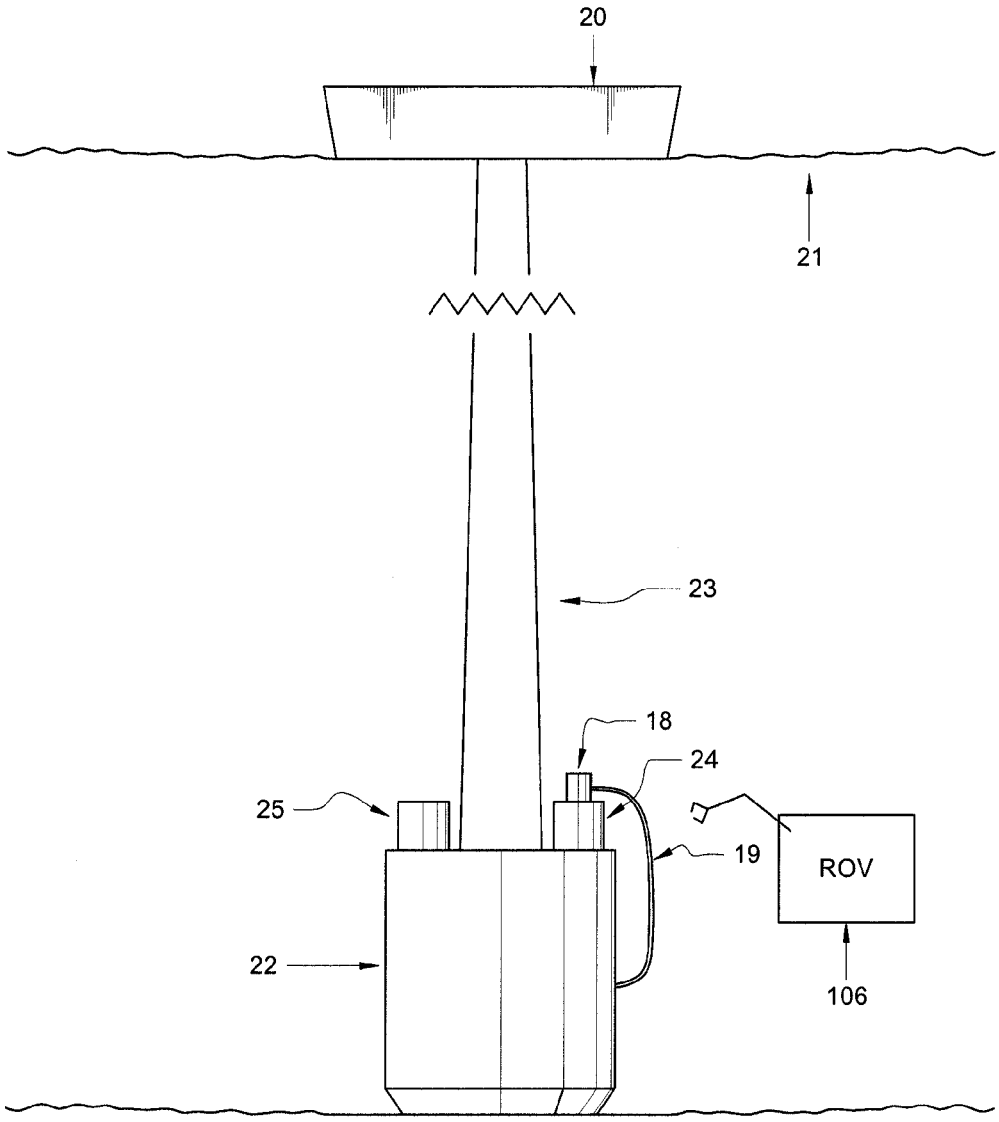
FIG. 2 is a schematic view of a deep sea drilling operation incorporating an embodiment of the present invention.

In some embodiments, fluid supply apparatus 10 is used to supply hydraulic fluids to BOP components. Referring also to FIG. 2, surface vessel 20 on water 21 connects to BOP stack 22 via marine riser pipe 23. Marine riser pipe 23 may carry a variety of supply lines and pipes, such as hydraulic supply lines, choke lines, kill lines, etc. In such embodiments, fluid source 13 is generally a main hydraulic supply line coming down marine riser pipe 23. Alternate fluid source 102 may include, but is not limited to, an accumulator, an auxiliary hydraulic supply line, an auxiliary conduit on marine riser 23, or a hydraulic feed from control pod 24.

In one embodiment, control pod 24 attaches to BOP stack 22 and modular valve block 18 attaches to control pod 24. Hose 19 connects modular valve block 18 to BOP stack 22. Control pod 24 may be any system used to control various BOP functions, and may include various combinations of valves, gauges, piping, instrumentation, accumulators, regulators, etc. Traditionally, the industry refers to control pod 24 and its redundant counter-part control pod 25 as a blue pod and yellow pod. Failure or malfunction of any one of the components inside of control pod 24 that is not backed up according to the present invention may require stopping drilling and servicing the control pod, which costs a lot of money. However, one embodiment of the present invention, including ROV 106, hose 19, and modular valve block 18, allows redundancy for components inside of control pod 24 by bypassing and isolating a malfunctioning component and rerouting the fluid flow through modular valve block 18 and hose 19.

Figure 3:
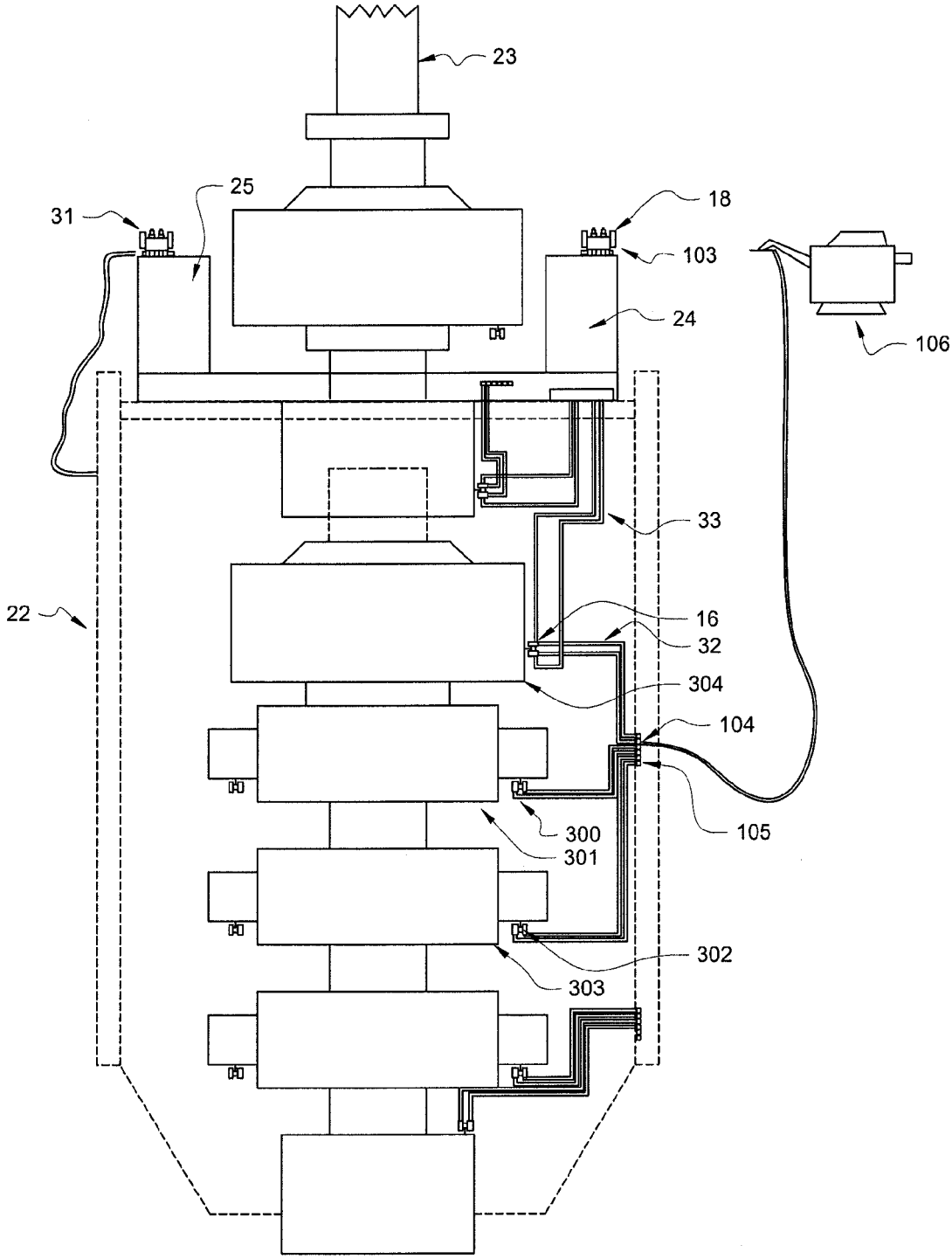
FIG. 3 is a side view of a BOP apparatus incorporating an embodiment of the present invention.

Referring to an embodiment of the present invention as demonstrated in FIG. 3, control pod 24 (e.g., a blue pod) attaches to BOP stack 22 and modular valve block 18 attaches to control pod 24. In addition, a second control pod 25 (e.g., a yellow pod) attaches to BOP stack 22 and a second modular valve block 31 attaches to control pod 25. In these embodiments, the destinations of the hydraulic fluid are BOP functions. Control pods 24 and 25 provide control to the various BOP functions, some of which are referred to by numbers 301, 303, and 304. BOP control functions include, but are not limited to, the opening and closing of hydraulically operated pipe rams, annular seals, shear rams designed to cut the pipe, a series of remote operated valves to allow controlled flow of drilling fluids, a riser connector, and well re-entry equipment. Control pods 24 and 25 are hard piped to the various BOP functions, including BOP functions 301, 303, and 304, which means that if one component in control pod 24 or 25 fails and must be repaired, the whole control pod or the LMRP must be disconnected and the control pod's control over BOP functions cease or are limited. As used herein, "hard piped" or "hard piping" refers to piping and associated connections that are permanent or not easily removed by an ROV. In addition, for safety and regulatory reasons, a drilling operation cannot or will not operate with only one working control pod. Thus, a failure of one component of one pod forces a drilling operation to stop. One embodiment of the present invention overcomes this problem in subsea drilling by providing modular and selectable backup control for many components in control modules 24 and/or 25.

Referring to FIG. 3, BOP functions 301, 303, and 304 connect via hard piping to intervention shuttle valves 16, 300, and 302, respectively. In this embodiment, intervention shuttle valve 16 is hard piped to temporary connection 104 on receiver plate 105 via hard piping 32. Intervention shuttle valves 300 and 302 also connect to other temporary connection receivers on receiver plate 105 via hard piping. In addition, control pod 24 connects to intervention shuttle valve 16 via hard piping 33. Although not shown, control pod 24 also connects to intervention shuttle values 300 and 302. When a control component in control pod 24 malfunctions, the BOP function to which the control component corresponds will not respond to normal commands (for instance, an annular will not shut). After it is determined that a BOP component is not working, ROV 106 may be directed to connect hose 19 at the connection receiver on receiver plate 105 that is hard piped to the nonresponsive function. In FIG. 3, ROV has connected hose 19 to temporary connection 104, one of several temporary connections on receiver plate 105. ROV 106 also connects hose 19 to modular valve block 18 at temporary connection 103. In other embodiments, ROV 106 connects hose 19 to modular valve block 18 first and then to intervention shuttle valve 16. In either scenario, the malfunctioning control component of control pod 24 is bypassed, and hydraulic fluid flows through a secondary route that includes modular valve block 18, hose 19, and intervention shuttle valve 16. The BOP function will now work properly, avoiding downtime.

In some embodiments, modular valve block 18 is designed to be robust in that it is capable of servicing several different BOP functions, each of which is selected by plugging hose 19 into the particular intervention shuttle valve associated with the BOP function experiencing control problems. The components on modular valve block 18, described in detail below, may provide redundancy for numerous components in control pod 24 and/or 25, making modular valve block generally universal and monetarily efficient. Even before a component failure arises, hose 19 may be connected to modular valve block 18 and a particular connection on receiver plate 105 to anticipate a malfunction of a particular component. Of course, if at a later time a different component fails than the one anticipated, ROV 106 can disconnect hose 19 from the first connection on receiver plate 105 and connect it to a different connection (the one corresponding to the malfunctioning BOP function) to allow backup control.

Modular Valve Block

Figure 4A:
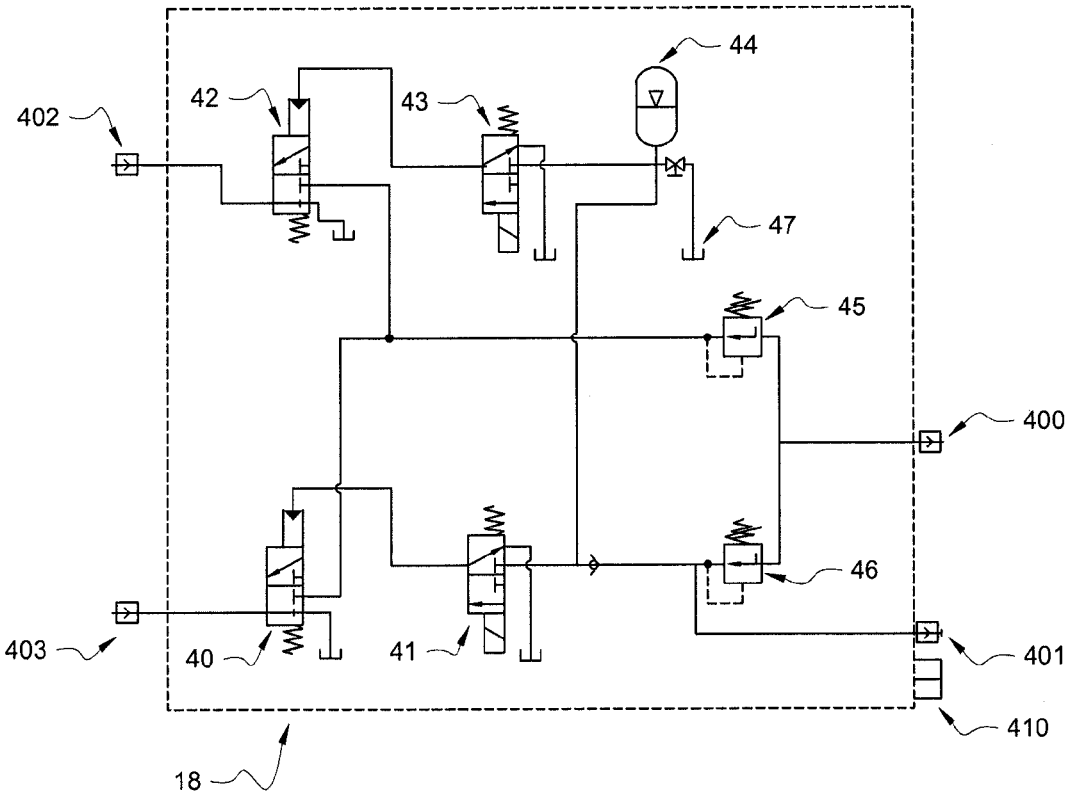
FIG. 4A is a schematic diagram of a modular valve block according to an embodiment of the present invention.

FIGS. 4A and B demonstrate one embodiment of modular valve block 18, which includes directional control valves 40 and 42 and pilot valves 41 and 43. Although two sets of valves and pilot valves are shown, any number of valves may be placed on the modular valve block 18. The number of directional control valves corresponds to the number of BOP functions that modular valve block 18 may simultaneously serve. However, modular valve block 18 in most cases is small enough to be retrievable by ROV 106. In some embodiments, modular valve block 18 comprises manifold pressure regulator 45 to control the hydraulic fluid supply pressure to systems components downstream of directional control valves 40 and 42, and pilot pressure regulator 46 to control pressure available to the pilot system. In some embodiments, pilot pressure regulator 46 is configured to also provide back feed hydraulic pressure to control pod 24.

In some embodiments, modular valve block 18 comprises pressure accumulator 44 to avoid any pressure loss when shifting pilot valves 41 and 43, and accumulator dump valve 47 to allow venting of accumulator 44 as required during normal operations. In some embodiments, pilot valves 41 and 43, pressure accumulator 44, manifold pressure regulator 45, and pilot pressure regulator 46 are not housed on modular valve block 18, but rather are placed upstream or are not required. While many BOP components require hydraulic fluid at the same pressure, in embodiments where modular valve block 18 is to be generically able to supply hydraulic fluid to different BOP components at different pressures (such as an annular compared to a shear ram), manifold pressure regulator 45 is advantageous. Various combinations of valves, pilots, regulators, accumulators, and other control components are possible, and in some embodiments, pilot valves 41 and 43 are solenoid operated pilot valves, while in other embodiments, they are hydraulic pilot valves. In addition, in some embodiments, BOP stack 22 is connected to a plurality of modular valve blocks, each of which may provide backup for one or more control component.

Figure 4B:
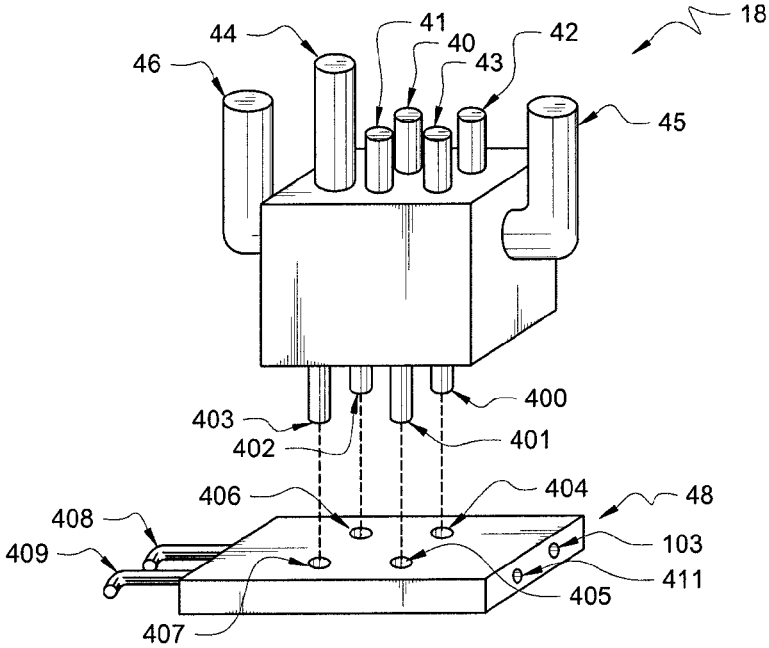
FIG. 4B perspective view of a modular valve block according to an embodiment of the present invention.

Modular valve block 18 further comprises connections 400, 401, 402, and 403 to connect to BOP stack 22. In some embodiments, connections 400, 401, 402, and 403 are pressure balanced stab connections that allow for removal and reinstallation via ROV 106. In embodiments requiring electrical connection, connection 410 is an electrical wet make connection to allow making and breaking of electrical connections underwater. Referring to FIG. 4B, modular valve block 18 mounts onto modular block receiver 48 in some embodiments. Modular block receiver 48 is fixably attached to BOP stack 22 and a hydraulic fluid supply is hard piped to it. According to the embodiment in FIG. 4B, modular block receiver 48 includes receptacles 404, 405, 406, and 407 to receive connections 400, 401, 402, and 403. Receptacles 404, 405, 406, and 407 and connections 400, 401, 402, and 403 are preferably universal so that the present invention can be installed on any number of BOP stacks and different modular valve blocks can attach to modular block receiver 48.

Hydraulic supply connections 408 and 409 supply hydraulic fluid and pilot hydraulic fluid to modular valve block 18. Any suitable source may supply hydraulic supply connections 408 and 409, such as, but not limited to, the main hydraulic supply, an accumulator, an auxiliary hydraulic supply line, an auxiliary conduit on marine riser 23, or a hydraulic feed from control pod 24. While temporary connection 103 may be housed on modular valve block 18 directly, it may also be housed on modular block receiver 48. In addition, one or more additional temporary connections 411 may be included. The number of temporary connections connected to modular valve block 18 generally will correspond to the number of directional control valves on modular valve block 18 and will also generally dictate how many BOP functions may be simultaneously served. Although temporary connection 103 is shown as exiting the side of modular block receiver 48, it may also exit at other locations on modular block receiver 48, such as on a bottom portion, pointing vertically in relation to the sea floor, for easy disconnect during emergency stack pulls.

Intervention Shuttle Valve

Figure 5A:
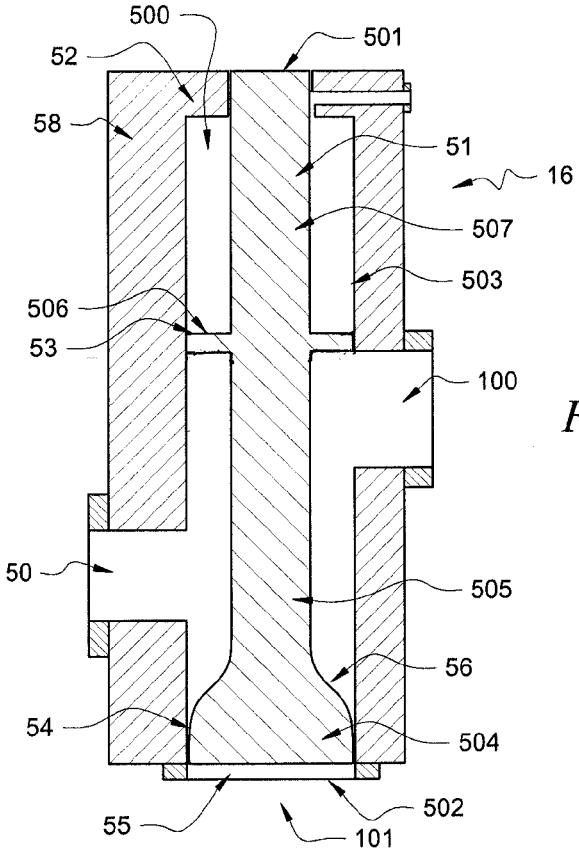
FIGS. 5A and B are cross sectional side views of an intervention shuttle valve according to embodiments of the present invention.

Referring to FIGS. 5A and B, intervention shuttle valve 16 comprises housing 58, generally cylindrical cavity 500, primary inlet 100, secondary inlet 101, generally cylindrical spool-type shuttle 51, and outlet 50. Cavity 500 comprises a top generally circular area 501, bottom generally circular area 502, and a side cylindrical area 503. Housing 58 has lip 52 above top generally circular area 503. In some embodiments, shuttle 51 comprises first region 504 nearest to secondary inlet 101 and having a radius substantially similar to that of cavity 500, second region 505 further from secondary inlet 101 and having a radius smaller than that of first region 504, third region 506 further still from secondary inlet 101 and having a radius substantially similar to that of cavity 500, fourth region 507 furthest from secondary inlet 101 and having a radius smaller than that of third region 506, and transition surface 56 between first region 504 and second region 505. Transition surface 56 may gradually slope between the radii of first region 504 and second region 505, or it may be an immediate change from the radius of first region 504 to that of second region 505 (in which case transition surface 56 is a flat surface normal to the cylindrical side of second region 505). In some embodiments, outlet 50 is hard piped to a destination, such as a BOP function, primary inlet 100 is hard piped to control pod 24, and secondary inlet 101 is hard piped to receiver plate 105. During normal flow, which corresponds to flow along primary fluid flow route 11 of FIG. 1, shuttle 51 is in the normal flow position and fluid enters primary inlet 100, flows around second region 505, and out outlet 50. Fluid does not flow to other areas because sealing areas 54 and 53, corresponding to first region 504 and third region 506, respectively, prevent fluid from leaking or flowing past them. Fluid flowing through primary inlet 100 applies a force against transition region 56 to keep shuttle 51 balanced. Accordingly, the shuttle value remains in the normal position.

Figure 5B:
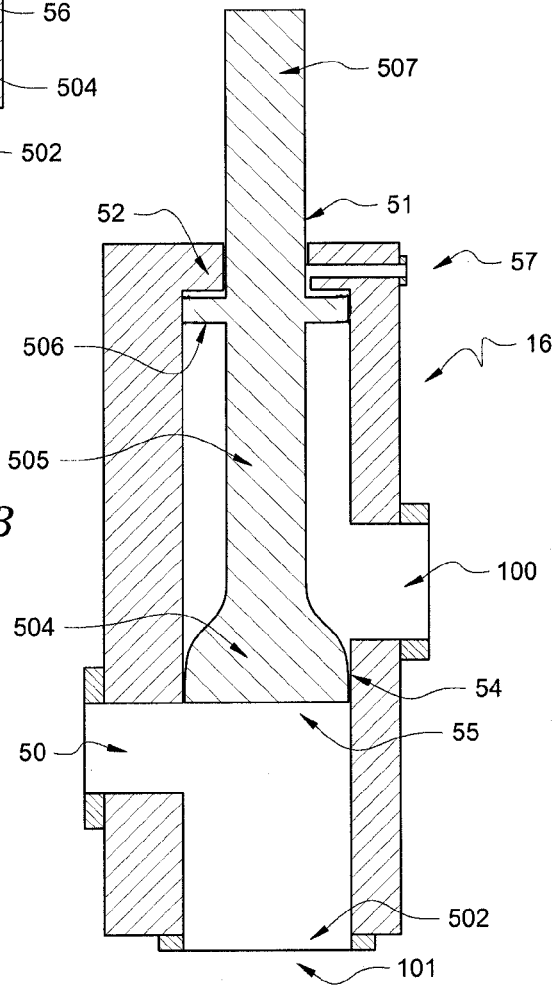

When it is desired to switch from normal flow to backup flow, fluid is introduced to secondary inlet 101, which applies pressure to broad face 55 of shuttle 51. Because the surface area of broad face 55 is greater than the surface area of transition zone 56, a flow of fluid in secondary inlet 101 at equal pressure to a fluid entering through primary inlet 100 will force shuttle 51 into the actuated position. FIG. 5B depicts an embodiment of intervention shuttle valve 16 with shuttle 51 in the actuated position. During flow in the actuated position, which corresponds to flow along secondary flow route 12 of FIG. 1, fluid enters secondary inlet 101 and out outlet 50. Fluid does not flow beyond shuttle 51 because sealing area 54 prevents flow. In addition, third region 506 hits lip 52, which prevents shuttle 51 from actuating any further. Thus, when shuttle 51 is in the actuated position, primary inlet 100 and components upstream of it are isolated and bypassed. Shuttle 51 may be reset at any time by supplying a fluid into bleed port 57 and forcing shuttle in the normal position.

Figure 6:
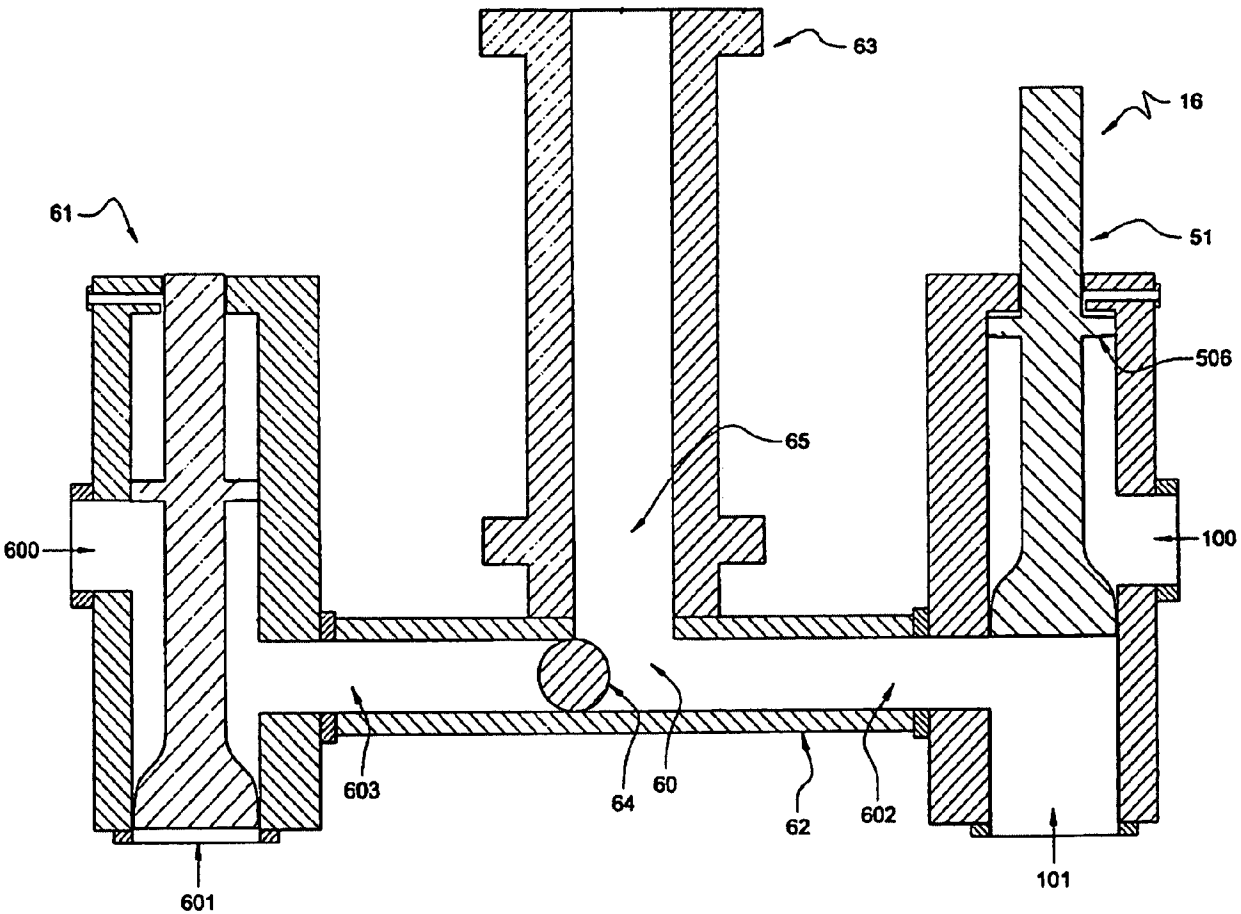
FIG. 6 is a cross sectional side view of a compound intervention shuttle valve according to an embodiment of the present invention.

Referring to FIG. 6, in some embodiments, intervention shuttle valve 16 is combined with other valves to form compound intervention shuttle valve 60. In some embodiments, compound intervention shuttle valve 60 comprises two intervention shuttle valves 16 and 61, gate intervention shuttle valve 62, primary inlets 100 and 600, secondary inlets 101 and 601, gate shuttle 64, and outlet 65. Connector 63 connects compound intervention shuttle valve 60 to a BOP function. The term "gate shuttle" is not mean to be limiting to any particular type of shuttle or valve, but is only used to distinguish it from intervention shuttle valve 16. Gate intervention shuttle valve 62 can be any shuttle valve that will shift to accept flow from only one side and isolate the other side.

Tracing one possible flow route in FIG. 6, flow enters through secondary inlet 101 of shuttle valve 16, forcing shuttle 51 into the actuated position. Flow continues out intervention shuttle valve 16 and into gate intervention shuttle valve 62, forcing gate shuttle 64 to the left and allowing flow out outlet 65 and isolating intervention shuttle valve 61. If flow through intervention shuttle valve 16 ceased and flow was introduced into shuttle valve 61, gate shuttle 64 would be forced to the right, isolating shuttle valve 16. In some embodiments, compound intervention shuttle valve 60 may be used to provide normal flow of hydraulic fluid from either the blue pod or yellow pod (e.g., control pods 24 and 25 of FIG. 3) and alternative flow from modular valve block 18 or 31 of FIG. 3. In such embodiments, compound intervention shuttle valve 60 will be capable of routing hydraulic fluid from four different sources to an outlet that leads to a BOP function. In some embodiments, the housings of intervention shuttle valves 16, 61, and 62 are made from a unitary piece of material, while in other embodiments the housings are made from distinct components and intervention shuttle valves 16, 61, and 62 are fixably attached to each other such that the outlets of intervention shuttle valves 16 and 61 flow into inlets 602 and 603 of gate intervention shuttle valve 62.

Schematic Flow Diagrams

Figure 7:
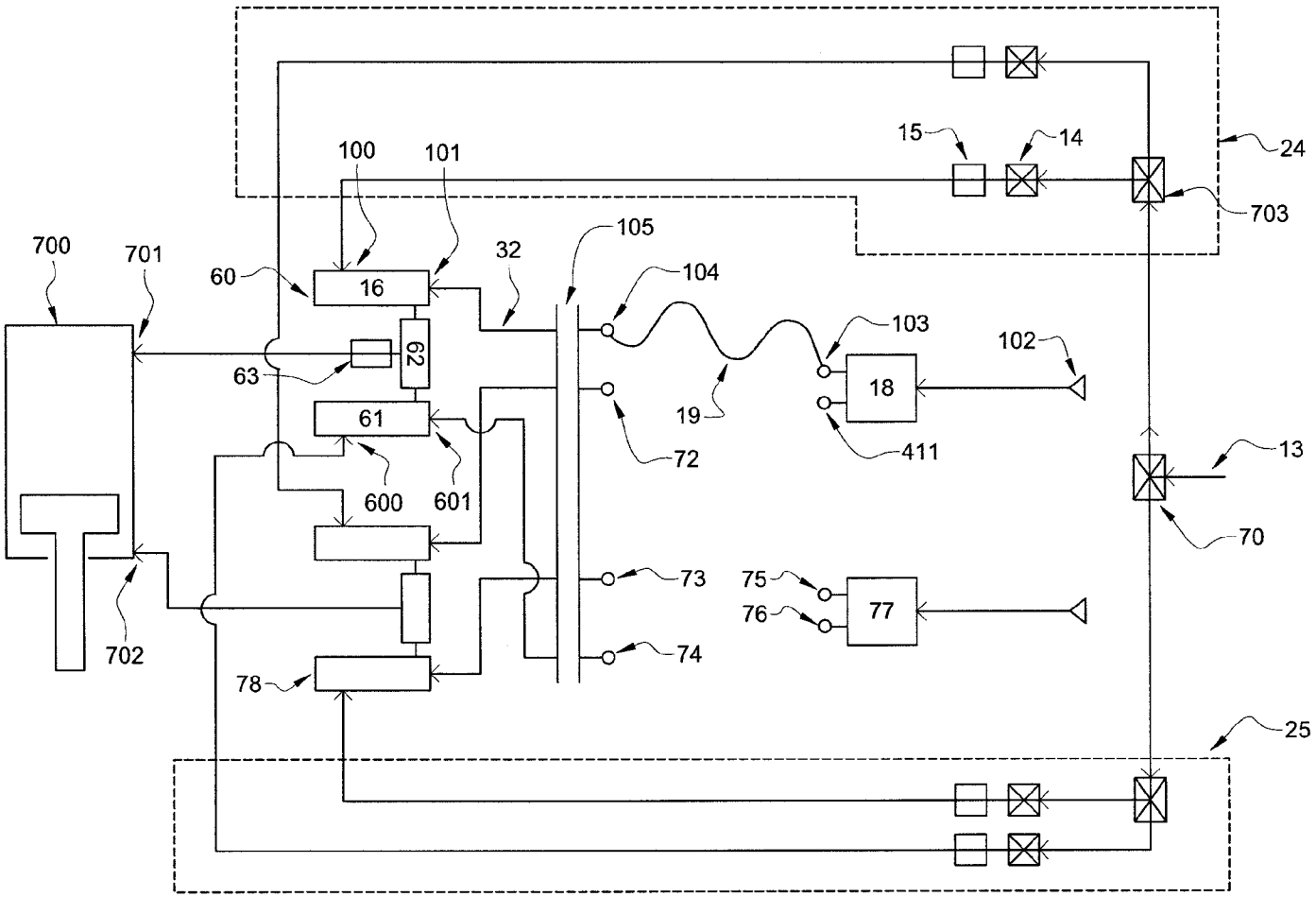
FIG. 7 is a schematic diagram of a BOP hydraulic control system incorporating an embodiment of the present invention.

FIG. 7 is a schematic including BOP pipe ram 700 and associated hydraulic feed systems. Fluid source 13 comprises a main hydraulic inlet and flows through valve 70 to either control pod 24 or control pod 25. In one possible flow route, valve 70 routes flow to control pod 24 and valve 703 routes flow through control components 14 and 15 to compound intervention shuttle valve 60. Referring FIGS. 6 and 7, in one embodiment compound intervention shuttle valve 60 has primary inlet 100 downstream of control pod 24, primary inlet 600 downstream of control pod 25, secondary inlet 101 downstream of temporary connection 104, and secondary inlet 601 downstream of temporary connection 74. Gate shuttle 64 isolates the inactive side of compound intervention shuttle valve 60 to allow flow through connector 63 to a BOP function. In this example, intervention shuttle valve 16 is in the actuated position to allow flow from secondary inlet 101, and gate shuttle 64 isolates intervention shuttle valve 61 and allows flow through intervention shuttle valve 16.

Although the destination of the hydraulic fluid can include any BOP function, FIG. 7 depicts an embodiment including two complementary destinations: the first function, "pipe ram close" 701, is associated with compound intervention shuttle valve 60 and opens pipe ram 700, and the second function, "pipe ram open" 702, is associated with compound intervention shuttle valve 78 and closes pipe ram 700. In this example, hose 19 connects temporary connection 103 and temporary connection 104 to route backup hydraulic flow to intervention shuttle valve 16 of compound intervention shuttle valve 60. Thus, control components 14 and 15 of control pod 24 that normally direct fluid to the function "pipe ram close" 701 have been isolated and bypassed, and fluid flow is routed through modular valve block 18, hose 19, and intervention shuttle valve 16 of compound intervention shuttle valve 60.

In the embodiment of FIG. 7, both pipe ram open 702 and pipe ram close 701 can be backed up for flow around control pod 24 and control pod 25. Thus, complete redundancy of control components are provided for both control pod 24 and control pod 25. Modular block valve 18 includes an additional outlet for temporary connection 411, and modular valve block 77 includes temporary connections 75 and 76. Similarly, receiver plate 105 includes additional ports for temporary connections 72, 73, and 74. As depicted, none of temporary connections 411, 75, 76, 72, 73, or 74 has a hose attached to it, but ROV 106 could attach a hose to those connections as needed. In some embodiments, due to the universal nature of modular block valves 18 and 77, ROV can attach hoses to any or all temporary connections 103, 411, 75, and 76 and route the hoses to any number of temporary connections that lead to other BOP functions (not shown). In some embodiments, BOP functions such as pipe ram open 702 and pipe ram close 701 can vent hydraulic fluid using backward flow through compound intervention shuttle valves 60 and 78 to vent lines (not shown).

It is also possible for the intervention shuttle valve 16 to provide emergency backup hotline flow to a BOP function in event of total loss of hydraulic control. In such embodiments, ROV 106 carries an emergency hydraulic supply line from the surface and connects it directly to temporary connection 104, which is connected to secondary inlet 101 of intervention shuttle valve 16, thus supplying hydraulic fluid in the event of other hydraulic fluid supply failure. In this manner, hydraulic fluid can be progressively supplied to any number of BOP functions in the event of catastrophic system failure.

In some embodiments, an electronic multiplex control system ("MUX") and an operator on the surface control and/or monitor BOP functions and hydraulic supply. In a simple sense, the MUX allows an operator to control BOP functions by the push of buttons or the like. For example the operator closes an annular by pressing a button or inputting an electronic command to signal the hydraulic system to close the annular. In some embodiments, the present invention is integrated into an existing multiplex system such that the initiation of backup hydraulic supply can be commanded by the push of a button. In addition, software can allow the switch between normal flow and backup flow to be transparent in that the operator pushes the same button to control a particular function whether normal or backup flow used.

Figure 8:
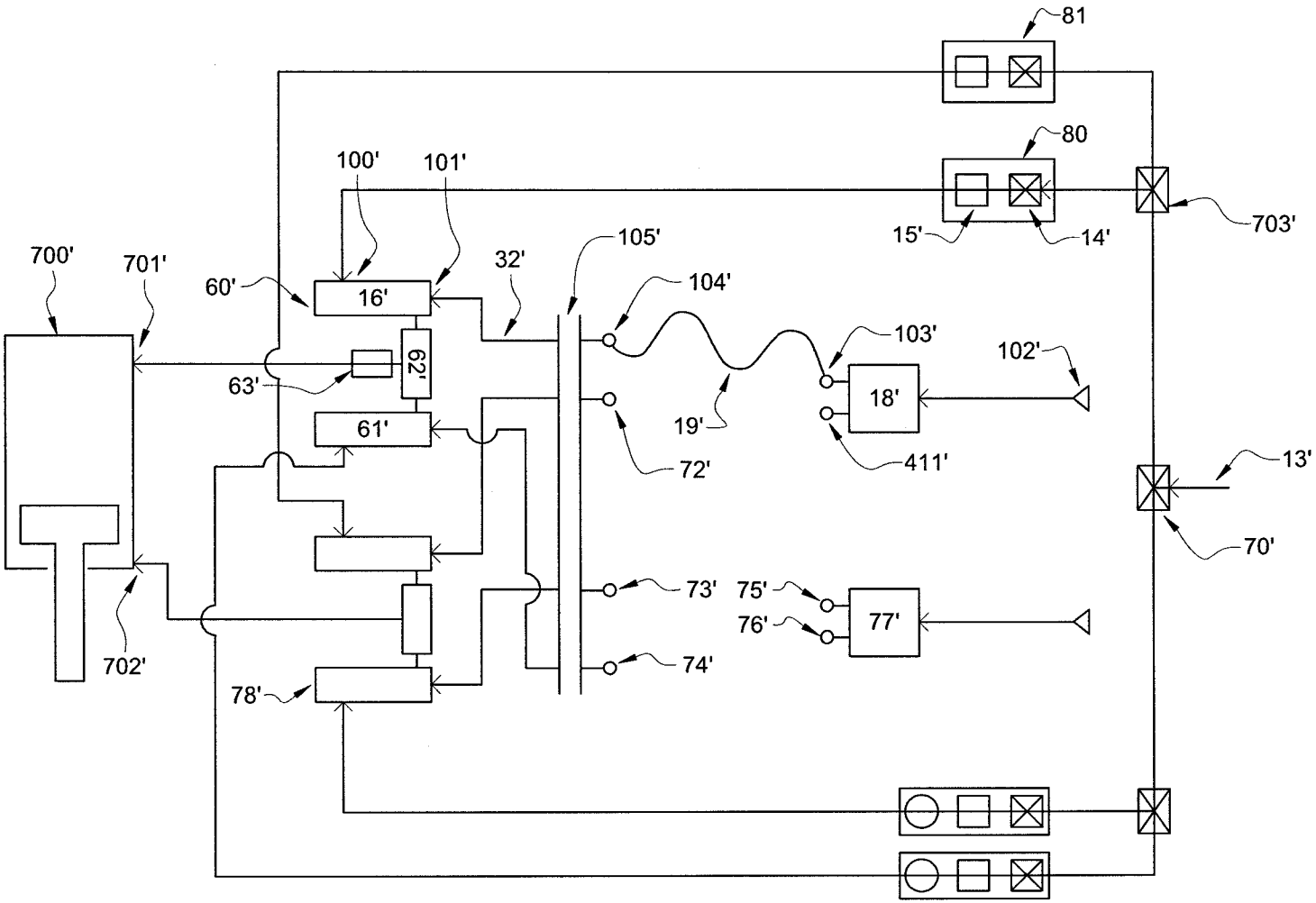
FIG. 8 is a schematic diagram of a BOP hydraulic control system incorporating an embodiment of the present invention.

In another embodiment of the present invention, shown in FIG. 8, central control pods (such as control pods 24 and 25 of FIG. 7) are entirely removed from the BOP hydraulic supply system. In place of central control pods, a plurality of primary, dedicated modular valve blocks and associated intervention shuttle valves are hard piped to the various BOP functions. By way of non-limiting example, primary modular valve blocks 80 and 81 are typically hard piped to compound intervention shuttle valves 60' and 78', respectively, but may be connected via temporary connections. Primary modular valve blocks 80 and 81 typically retrievably mount to modular receiver plates, but may mount directly on the BOP stack. Having a plurality of primary modular valve blocks makes repairing a malfunctioning primary control component easier and more cost efficient because an ROV can retrieve the particular malfunctioning primary modular valve block instead of retrieving an entire central control pod. In some embodiments, primary modular valve blocks are backed up with a one or more secondary modular valve blocks, such as secondary modular valve blocks 18' and 77', that connect to intervention shuttle valves via one or more hoses 19'. Thus, total hydraulic control is redundantly supplied via easily retrievable modular valve blocks. In addition to being easily retrievable, the plurality of modular valve blocks save money through economy of scale because they can be mass produced.

Flow Diagrams

Figure 9A:
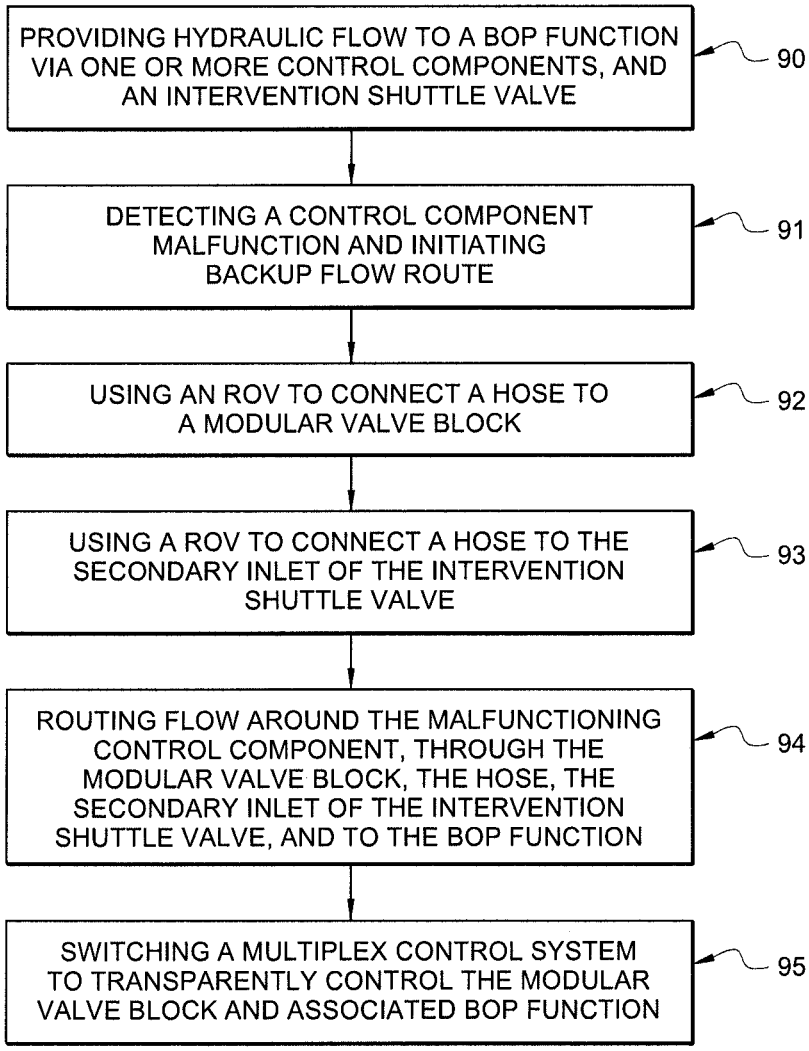
FIGS. 9A and B are flow charts showing embodiments of methods of using the present invention.

Referring to FIG. 9A, in one embodiment a method provides backup fluid flow to a destination. In some embodiments, referring to box 91, an operator initiates an alternate fluid flow route, such as when he detects a malfunctioning function and/or he needs to route flow around a control component. In some embodiments, the fluid is hydraulic fluid and the destination is a BOP function. Referring to boxes 92 and 93, a ROV is deployed to connect a hose to a modular valve block and a secondary inlet of an intervention shuttle valve. After the hose is connected, flow is sent through the modular valve block, hose, and secondary inlet of the intervention shuttle valve and to the destination as shown in box 94. In some embodiments, as shown in box 95, multiplex control of the hydraulic flow to the function is transparently switched such that operator can control the BOP function via the modular valve block using the same button or input means that controlled the malfunctioning control component.

Figure 9B:
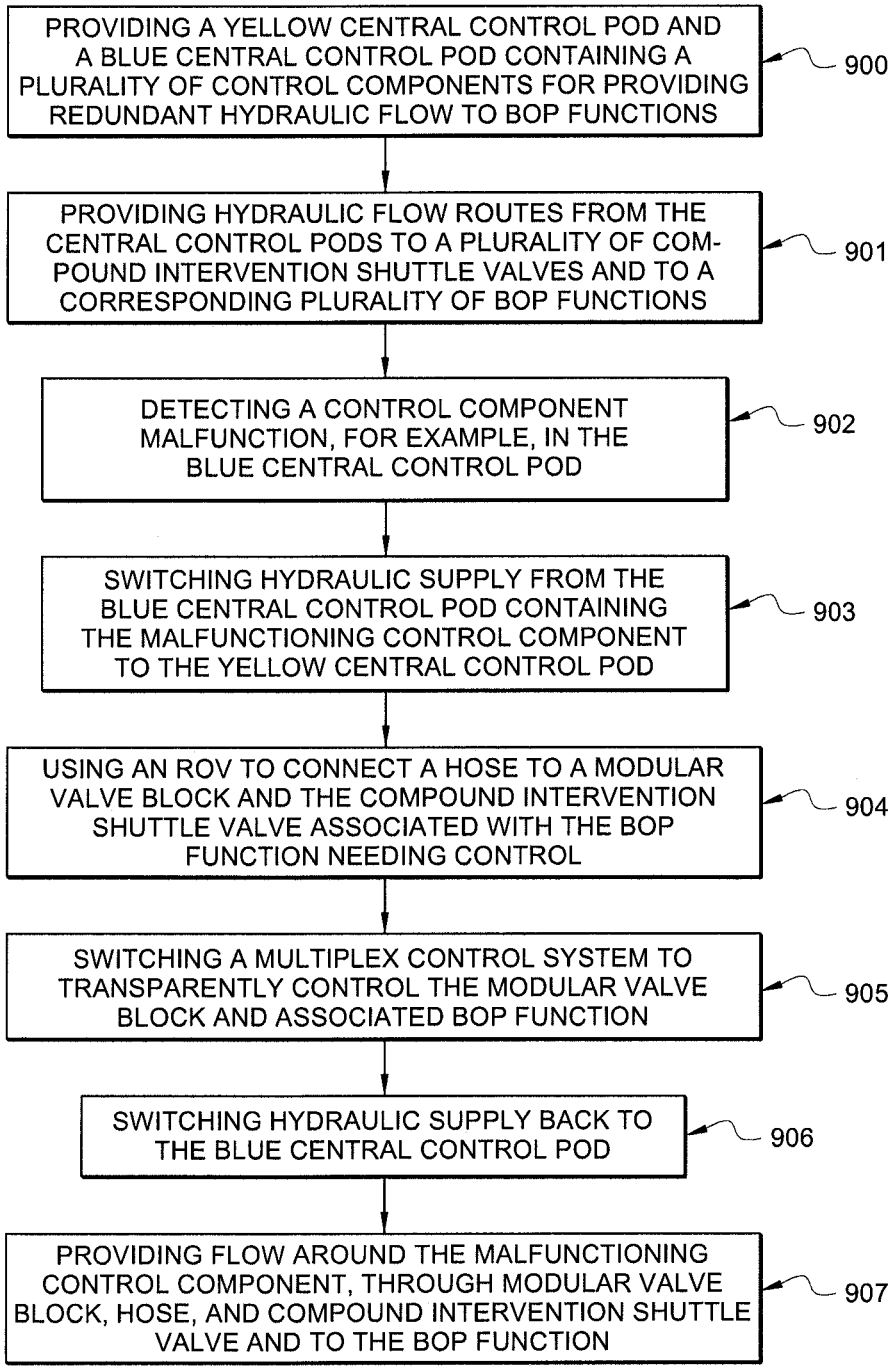

FIG. 9B shows an embodiment of the present invention involving blue and yellow central control pods to supply hydraulic fluids to one or more BOP functions. In one embodiment, hydraulic fluid is supplied by the blue pod, but a control component malfunction is detected as shown in box 902. In some embodiments, as shown in box 903, hydraulic supply switches from the blue pod to the yellow pod, the switch resulting from either operator input or automatic computer initiation. Of course, in another embodiment, control could remain in the blue pod while backup flow is initiated. Referring to box 904, an ROV is deployed and connects a hose to modular valve block and to the compound intervention shuttle valve associated with the proper BOP function. In some embodiments, as shown in box 905, multiplex control of the hydraulic flow to the function is transparently switched such that an operator can control the BOP function via the modular valve block using the same button or input means that controlled the now-malfunctioning control component. Referring to box 906, hydraulic supply may be switched back to the blue pod, and hydraulic fluid flows around the malfunctioning control component, through the modular valve block, and to the BOP function, restoring hydraulic control of the BOP function through the blue pod.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method, comprising:

providing fluid flow to a drilling component with one or more control components, a modular valve block and an intervention shuttle valve;

detecting a malfunctioning control component;

connecting a hose to the modular valve block and to a secondary inlet of the intervention shuttle valve;

routing flow around the malfunctioning control component; and switching a multiplex control system to control the modular valve block and the drilling component.

2. The method of claim 1, in which the step of connecting the hose comprises controlling a remote operated vehicle (ROV) to connect the hose to the modular valve block and to the secondary inlet of the intervention shuttle valve.

3. The method of claim 1, in which the step of routing flow around the malfunctioning control component comprises routing flow through the modular valve block, the hose, and the secondary inlet of the intervention shuttle valve to the drilling component.

4. The method of claim 1, in which the step of switching the multiplex control system comprises switching the multiplex control system to transparently control the modular valve block and the drilling component.

5. The method of claim 1, in which the step of providing fluid flow to the drilling component comprises providing hydraulic fluid flow to the drilling component.

6. The method of claim 5, in which the step of providing hydraulic fluid flow to the drilling component comprises providing hydraulic fluid flow to a blowout preventer (BOP) component.

7. The method of claim 1, further comprising generating the fluid flow with at least one of an accumulator, an auxiliary supply line, an auxiliary conduit on a marine riser, and a fluid feed from a control pod.

8. The method of claim 1, in which the step of connecting the hose to the modular valve block comprises connecting the hose to a valve on the modular valve block corresponding to the drilling component.

9. The method of claim 1, further comprising controlling a pressure of the fluid flow through the modular valve block with a pressure regulator.

10. The method of claim 9, further comprising activating a dump valve on the modular valve block to decrease the pressure of the fluid flow through the modular valve block.

11. A method, comprising:

providing a first control pod, a second control pod and at least one modular valve block, in which the first control pod and the second control pod provide redundant fluid flow to a drilling component;

providing fluid flow routes from each of the first control pod and the second control pod to a plurality of intervention shuttle valves;

detecting a malfunction in the first control pod;

switching the fluid flow from the first control pod to the second control pod;

coupling the modular valve block to at least one of the intervention shuttle valves; and switching a multiplex control system to control the at least one modular valve block and the drilling component.

12. The method of claim 11, further comprising switching the fluid flow from the second control pod to the first control pod.

13. The method of claim 12, further comprising providing flow around the malfunction in the first control pod through the at least one modular valve block and the intervention shuttle valve to the drilling component.

14. The method of claim 11, in which the step of providing fluid flow routes comprises providing routes from each of the first control pod and the second control pod to a plurality of compound intervention shuttle valves.

15. The method of claim 11, in which the step of providing fluid flow to the drilling component comprises providing hydraulic fluid flow to the drilling component.

16. The method of claim 15, in which the step of providing hydraulic fluid flow to the drilling component comprises providing hydraulic fluid flow to a blowout preventer (BOP) component.

17. The method of claim 11, in which the step of coupling the at least one modular valve block and at least one of the intervention shuttle valves comprises connecting a hose to the at least one modular valve block and to at least one of the intervention shuttle valves.

18. The method of claim 17, in which the connecting step is performed by a remote operated vehicle (ROV).

19. The method of claim 11, further comprising controlling a pressure of the fluid flow through the at least one modular valve block with a pressure regulator.

20. The method of claim 19, further comprising activating a dump valve on the at least one modular valve block to decrease the pressure of the fluid flow through the modular valve block.

* * * * *